US005481245A

United States Patent [19]

Moldavsky

[11] Patent Number: 5,481,245

[45] Date of Patent: Jan. 2, 1996

[54] MONITORED ENVIRONMENT CONTAINER

[75] Inventor: Boris Moldavsky, Dana Point, Calif.

[73] Assignee: Grumman Aerospace Corporation, Bethpage, N.Y.

[21] Appl. No.: 179,925

[22] Filed: Jan. 11, 1994

[51] Int. Cl.[6] ..... G08B 21/00

[52] U.S. Cl. ..... 340/540; 340/571; 340/686; 340/584; 340/588; 340/689; 340/693

[58] Field of Search ..... 340/540, 571, 340/521, 586, 545, 665, 669, 686, 689, 693, 585; 364/557–559, 449, 429; 379/58; 235/375, 376, 384

[56] References Cited

U.S. PATENT DOCUMENTS 4,688,244 8/1987 Hannon et al. ..... 379/58
4,750,197 6/1988 Denekamp et al. ..... 379/58
4,791,411 12/1988 Starr ..... 340/585
5,051,725 9/1991 Caccitolo ..... 340/693

*Primary Examiner*—John K. Peng
*Assistant Examiner*—Benjamin C. Lee
*Attorney, Agent, or Firm*—Stetina Brunda & Buyan

[57] ABSTRACT

A container for transporting, storing, and handling sensitive items has a housing within which at least one sensitive item is stowable, and a monitoring system for monitoring a plurality of separate parameters to which the sensitive item(s) are sensitive. The monitoring system records and provides data regarding the parameters to which the sensitive item(s) are sensitive. The monitoring systems preferably utilizes such sensors as a vibration sensor, a shock sensor, a temperature sensor, a humidity sensor, a magnetic field sensor, an unauthorized opening sensor, and/or an attitude sensor.

10 Claims, 1 Drawing Sheet

MONITORED ENVIRONMENT CONTAINER

FIELD OF THE INVENTION

The present invention relates generally to containers and more particularly to a container for transporting, handling, and storing sensitive items wherein the environment of the container is monitored and recorded such that data regarding desired parameters relating to the environment may later be recalled.

BACKGROUND OF THE INVENTION

Specialized containers for transporting, handling, and storing sensitive items are known. Such containers typically utilize durable outside shells, cushioned inner supports for the stowed sensitive items, and sealed openings to prevent the undesirable introduction of moisture. Cushioned external supports, i.e. air bags, as well as thermal insulation may likewise be utilized, when desired.

It is also known to individually monitor selected environmental parameters such as shock, temperature, and humidity so as to provide an indication of the levels of such parameters to which the stowed sensitive item is exposed. The monitoring of such parameters is accomplished utilizing dedicated separate autonomous monitoring devices.

The use of such dedicated separate autonomous monitoring devices requires that separate power sources, sensors, and recording means be provided for each device. As such, considerable redundancy in the hardware required for such monitoring exists.

Additionally, such dedicated separate devices must be individually installed, maintained, and read. Thus, use of such dedicated individual monitoring devices is comparatively complex and time intensive.

Additionally, it is known to seal containers housing critical or sensitive items so as to provide an indication that the container has been opened. Particularly, opening by unauthorized personnel can likewise be revealed, since authorized personnel typically are capable of resealing the container. However, no indication of the number of times that the container has been opened, either by authorized or unauthorized personnel, is provided.

As such, it would be beneficial to provide an easy to use, low maintenance, monitoring system for providing desired information regarding a variety of different environmental parameters and also indicating the number of times that the container has been opened, both by authorized and unauthorized personnel.

SUMMARY OF THE INVENTION

The present invention specifically addresses and alleviates the above-mentioned deficiencies associated with the prior art. More particularly, the present invention comprises a container for transporting, storing, and handling sensitive items. The container comprises a housing within which at least one sensitive item is stowable and a monitoring system for monitoring a plurality of separate parameters to which the sensitive items are sensitive. The monitoring system records and provides data regarding the parameters to which the sensitive item is sensitive.

The monitoring system monitors a variety of different environmental parameters such as vibration, shock, temperature, humidity, magnetic field strength, unauthorized opening of the container, and attitude of the container.

Optionally, a display may be utilized to provide the data regarding the parameters to which the sensitive item is sensitive. The monitor may optionally additionally provide warning messages and/or instructions when the monitoring system receives an indication that an environmental parameter has exceeded a predetermined value.

For example, such warning messages may comprise messages indicating that a particular environmental parameter has been exceeded and that the contents of the container may no longer be usable or may require rework. Instructions may also be provided so as to mitigate further damage to the sensitive items housed within the container, provide information necessary for rework, or provide information on whom to contact or inform of the situation. Those skilled in the art will recognize that a variety of such messages, dependent upon the particular sensitive item being stowed within the container and the nature of the environmental parameter whose preset value is exceeded, are likewise suitable.

The housing preferably comprises a plurality of partitions defining a plurality of cells within which the sensitive items are stowable. The monitoring system preferably individually monitors each of the cells. Optionally, each cell may be individually configured such that the monitoring system monitors only desired environmental parameters therein. Thus, each cell of the container may be customized for containing a particular sensitive item.

The partitions preferably define inner and outer cells, the inner cells being configured to receive the sensitive items and the outer cells substantially containing the monitoring system.

The monitoring system preferably comprises a microprocessor, a memory, a self-contained power source such as a battery, a clock, and a plurality of sensors interconnected with the microprocessor. The sensors preferably comprise a vibration sensor, a shock sensor, a temperature sensor, a humidity sensor, a magnetic field sensor, an unauthorized opening sensor, and an attitude sensor. Those skilled in the art will recognize that various other sensors are likewise suitable, depending upon the particular desired environmental parameters to the monitor.

The monitoring system preferably comprises a port for downloading instructions regarding the parameters to be monitored. For example, a list of the individual parameters to be monitored, the preset levels for triggering messages, and the messages to be displayed could be downloaded from a host computer to the monitoring system via the port.

The port may optionally also be utilized for uploading the results of monitoring the environmental parameters. Thus, the results of the monitoring process may be uploaded to a host computer, then analyzed and/or a report prepared by the hose computer indicating the results of the monitoring process.

Thus, in use, sensitive items within a container are monitored during transport, storage, and handling thereof via a monitoring system which monitors a plurality of sensors which in turn sense parameters to which the sensitive components are sensitive. Data received from the individual sensors is recorded and provided for later display, uploading, etc.

Items having differing environmental criteria may be stored within different portions or cells of the container wherein the different individual cells of the container are environmental monitored accordingly. For example, a component particularly sensitive to temperature would be stored in a cell wherein temperature is monitored and a component particularly sensitive to shock would similarly be stored in a cell wherein shock is monitored. Those skilled in the art will recognize that various different combinations of sensors may thus be utilized in various different cells, as desired.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the intended drawings is intended as a description of the presently preferred embodiment of the invention, and is not intended to represent the only form in which the present invention may be constructed or utilized. The description sets forth the functions and sequence of steps for constructing and operating the present invention in connection with the illustrated embodiment. It is to be understood, however, that the same or equivalent functions and sequences may be accomplished by different embodiments that are also intended to be encompassed within the spirit and scope of the invention.

The monitored environment container of the present invention is illustrated in FIGS. 1–4 which depict a presently preferred embodiment of the invention.

Figure 1:
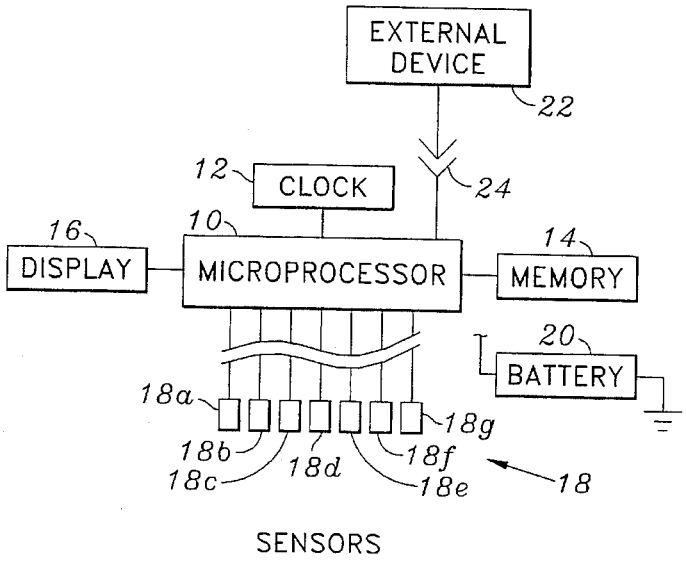
FIG. 1 is an electrical block diagram of the monitoring system of the monitored environment container of the present invention.

Referring now to FIG. 1, the monitoring system for monitoring a plurality of separate parameters to which sensitive items are sensitive comprises a microprocessor 10, in electrical communication with a clock 12, a memory 14, a display 16, and a plurality of sensors 18. The sensors 18 preferably comprise a vibration sensor 18*a*, a shock sensor 18*b*, a temperature sensor 18*c*, a humidity sensor 18*d*, a magnetic field sensor 18*e*, and unauthorized opening sensor 18*f*, and an attitude sensor 18*g*. An autonomous power source, e.g. a battery, 20 supplies power to the microprocessor 10, clock 12, memory 14, display 16, and any associated electronics.

The microprocessor 10 executes instructions which facilitate processing of inputs from the sensors 18. Those skilled in the art will recognize that various signal conditioning circuitry may be required intermediate the sensors 18 and the microprocessor 10, depending upon the type of sensors 18 utilized and the nature of their electrical outputs.

The instructions or program stored in memory 14 and executed by the microprocessor 10 preferably include preset limits, which, when exceeded, causes the appropriate sensor outputs to be stored within the memory 14.

The display 16 displays the values of those sensors 18 which have exceeded preset limits. Optionally, the display 16 may also display warning messages, instructions, etc. For example, the process steps to which the contents of the container are to be subjected may be sequentially displayed upon the monitor so as to facilitate proper processing thereof.

Figure 4:
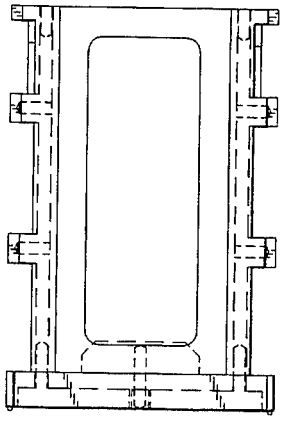
FIG. 4 is an end view of the monitored environment container of FIGS. 2 and 3.
Figure 2:
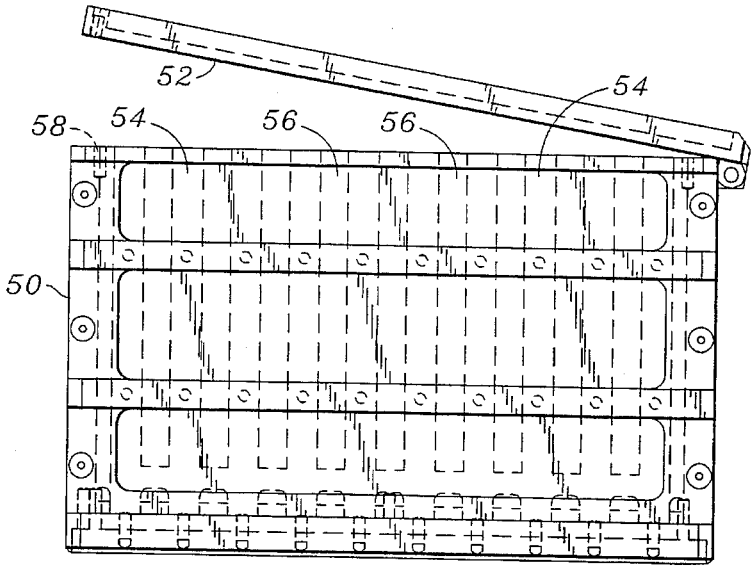
FIG. 2 is a side view of the housing of the monitored environment container of the present invention.
Figure 3:
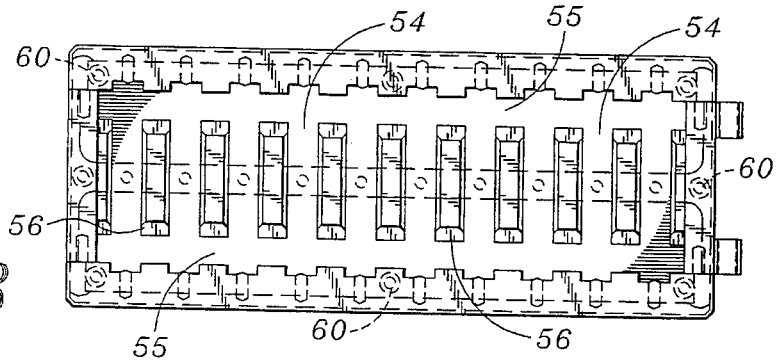
FIG. 3 is a top view of the monitored environment container of the FIG. 2.

Referring to FIGS. 2–4, the housing comprises a box 50 having a lid 52. The box 50 is divided into a plurality of inner cells 54 and outer cells 55 by partitions 56. The inner cells 54 are generally surrounded by the outer cells 55. The outer cells 55 are disposed about the periphery of the box 50. An open/close switch 58 senses whether the lid 52 or the closed position. Mercury tilt switches 60, preferably three, one for each axis, sense the attitude or orientation of the housing. As those skilled in the art will appreciate, various other sensors may be utilized, as desired.

Monitoring the plurality of sensors preferably comprises maintaining the microprocessor in an inactive state and maintaining the clock in an active state until an input is received from one of the sensors, then activating the microprocessor such that the microprocessor records data representative of the sensor input. After recording data representative of the sensor input, the microprocessor preferably returns to the inactive state.

It is understood that the exemplary monitored environment container described herein and shown in the drawings discloses only presently preferred embodiment of the invention. Indeed, various modifications and additions may be made to such embodiment without departing from the spirit and scope of the invention. For example, the box may be of various different sizes and configurations and need not be generally rectangular as described and illustrated. Also, those skilled in the art will realize that various other types of sensors are likewise suitable for sensing the level of various other parameters. Thus, these and other modifications and additions may be obvious to those skilled in the art may be implemented to adapt the present invention for use in a variety of different applications.

What is claimed is:

1. A container for transporting, storing, and handling sensitive items, the container comprising:

a) a housing configured to store at least one sensitive item, said housing comprising a plurality of partitions defining inner cells surrounded by outer cells, said inner cells being configured to receive the sensitive item(s); and b) a monitoring system, at least a portion of which is disposed within said outer cells, for individually monitoring the inner cells for a plurality of separate parameters to which the sensitive items(s) are sensitive;

c) wherein said monitoring system records and provides data in response to said monitoring regarding the parameters to which the sensitive item(s) are sensitive.

2. The container as in claim 1 wherein said monitoring system comprises at least one item selected from a group consisting of:

a) a vibration sensor;

b) a shock sensor;

c) a temperature sensor;

d) a humidity sensor;

e) a magnetic field sensor;

f) an unauthorized opening sensor; and g) an attitude sensor.

3. The container as recited in claim 1 further comprising a display responsive to said monitoring system to display said data.

4. The container as recited in claim 1 wherein said monitoring system individually monitors a plurality of the inner cells.

5. The container as recited in claim 1 wherein said monitoring system comprises:

a) a microprocessor;

b) memory in electrical communication with said microprocessor;

c) a battery providing electrical power to said microprocessor;

d) a clock in electrical communication with said microprocessor;

e) a plurality of sensors individually allotted for the inner cells in electrical communication with said microprocessor.

6. The container as recited in claim 1 wherein said monitoring system comprises a port for downloading instructions regarding the parameters to be monitored.

7. The container as recited in claim 1 wherein said monitoring system comprises a port for uploading monitoring results.

8. The container as recited in claim 1 wherein said outer cells comprise a peripheral outer volume extending about each of a plurality of substantially identical inner cells.

9. The container as recited in claim 1 wherein each of said inner cells are defined by an opposed pair of partitions.

10. A container for transporting and handling sensitive items, said container comprising:

a) a housing comprising a plurality of partitions defining a plurality of inner and outer cells;

b) a monitoring system for individually monitoring the inner cells for a plurality of separate parameters to which the sensitive items are sensitive, the monitoring system comprising:

(i) a microprocessor;

(ii) memory in electrical communication with said microprocessor;

(iii) a battery providing electrical power to said microprocessor;

(iv) a plurality of sensors individually allotted for the inner cells in electrical communication with said microprocessor and selected from a group consisting of:

(a) a vibration sensor;

(b) a shock sensor;

(c) a temperature sensor;

(d) a humidity sensor;

(e) a magnetic field sensor;

(f) an unauthorized opening sensor; and (g) an attitude sensor;

c) a display responsive to said monitoring system; and d) a port for communicating with an external device;

e) said inner cells being configured to receive the sensitive item(s) and said outer cells containing at least a portion of said monitoring system;

f) wherein said monitoring system monitors desired ones of said sensors within desired ones of said cells, and wherein said display displays messages regarding parameters monitored by said sensors, and wherein said port facilitates downloading of instructions regarding the parameters to be monitored and uploading of monitoring results.

* * * * *